US005890348A

United States Patent [19]

Nützi et al.

[11] Patent Number: 5,890,348

[45] Date of Patent: Apr. 6, 1999

[54] METHOD AND APPARATUS FOR THE AUTOMATIC CLOSING OF TRANSPORT BAGS

[75] Inventors: Markus Nützi, Niederglatt; Peter Näf, Heiden, both of Switzerland

[73] Assignee: Buhler AG, Uzwil, Switzerland

[21] Appl. No.: 446,835

[22] PCT Filed: Sep. 28, 1994

[86] PCT No.: PCT/CH94/00193

§ 371 Date: Dec. 8, 1995

§ 102(e) Date: Dec. 8, 1995

[87] PCT Pub. No.: WO93/09765

PCT Pub. Date: Apr. 13, 1995

[30] Foreign Application Priority Data

| | | | |
|---|---|---|---|
| Oct. 4, 1993 | [CH] | Switzerland | 2977/93 |
| Jan. 17, 1994 | [CH] | Switzerland | 136/94 |

[51] Int. Cl.[6] ..... B65B 7/06

[52] U.S. Cl. ..... 53/481; 53/504; 53/372.5; 53/372.7; 53/375.7

[58] Field of Search ..... 53/504, 481, 482, 53/480, 476, 67, 375.2, 375.5, 375.7, 375.8, 377.4, 370.2, 370.3, 371.7, 372.2, 372.7, 372.8, 370.6, 372.5; 493/255, 308

[56] References Cited

U.S. PATENT DOCUMENTS

| | | | |
|---|---|---|---|
| 1,986,043 | 1/1935 | Carter | 53/372.2 |
| 2,514,867 | 7/1950 | Howard et al. | 53/375.7 |
| 3,782,069 | 1/1974 | Fischbein et al. | 53/67 |
| 3,953,956 | 5/1976 | Massman | 53/208 |
| 4,292,786 | 10/1981 | Long et al. | 53/527 |
| 4,507,906 | 4/1985 | Meyer . | |
| 5,152,124 | 10/1992 | Ishii et al. | 53/372.5 |

FOREIGN PATENT DOCUMENTS

| | | | |
|---|---|---|---|
| 1 538 565 A2 | 4/1993 | European Pat. Off. . | |
| 1043922 | 11/1958 | Germany | 53/371 |
| 1 931 100 | 1/1971 | Germany . | |
| 2038763 | 7/1980 | United Kingdom | 53/370.6 |

*Primary Examiner*—James F. Coan
*Assistant Examiner*—Gene L. Kim
*Attorney, Agent, or Firm*—Finnegan, Henderson, Farabow, Garrett & Dunner

[57] ABSTRACT

The invention relates to a method and an apparatus for the automatic closing of transport bags, especially bags made of paper for meal, fodders and the like, with a mass of more than 5 kg. The filled bags are first spread and are aligned in their height, subsequently clamped and provided with a double fold. An adhesive is applied between the folding steps and the double fold formed is pressed together with the adhesive joint in press rollers.

30 Claims, 6 Drawing Sheets

METHOD AND APPARATUS FOR THE AUTOMATIC CLOSING OF TRANSPORT BAGS

BACKGROUND OF THE INVENTION

1. Field of Invention

The invention relates to a method for the automatic closing of transport bags after filling with a bulk material, according to the pre-characterizing clause of claim 1, and to an apparatus for carrying out the method.

The method according to the invention and the associated apparatus are used particularly in the bagging and closing of transport bags (preferably paper bags) for large packs (approximately 10–50 kg) of meals, fodders and the like.

2. Description of Related Art

The closing of small consumer packs of up to approximately 2 kg is usually carried out in high-performance automatic packaging machines. Because of the smallness of the masses to be moved and of the paper areas, the cycles of movement can be executed at high speed, thus allowing very high performances.

In contrast, large packs having masses greater than 5 kg require completely different handling. The transport bags often used for these can have a mass of up to 50 kg and more. Even when some tendency towards smaller packs can be observed, the masses to be moved, the unstable type of package and the sheet-like bag parts allow only comparatively low accelerations. Excessive accelerations would damage the bag material or would deform the package, together with the orifice, in such a way, that it becomes useless for subsequent work steps.

Although, in so-called valve bags, closing presents relatively little problem on account of the filling orifice which can be closed in a valve-like manner, nevertheless, for reasons of bagging capacity, the empty-bag price and sanitation, they are used to only a qualified extent for foodstuffs and fodders.

Foodstuffs and fodders, especially also ground materials, require a leakproof closing of the transport bag in both directions. Neither should the filling material escape from the bag, nor should moisture, harmful substances or insects penetrate. The transport bags must be closed carefully by sewing (holes, perforation) or preferably by glueing/adhesive bonding.

Also, even small differences in density of the bag content result in differences in the degree of filling. Since, in the non-closed state, a transport bag does not have any exactly defined cubic dimensions, its automated handling and palletization present problems. Each bag must nevertheless be shaped uniformly and should also not include any air cushions, in order to produce a transportable bag stack (palletization). It is therefore impossible, for example, to wish to increase merely the degree of mechanization of a bag-closing apparatus. In addition, there are widely varying batch sizes which necessitate a frequent conversion of the apparatus.

At the same time, there are also limits on sewing which is widely used. The sewing speed cannot be increased arbitrarily, and bags made of thin material (weight reduction) cannot be sewn so as to be leakproof and tend to tear. The glueing/adhesive bonding of the bags constitutes a basic solution.

In a filled and non-spread transport bag, the position of the edges of the bag orifice can vary greatly, this making exact sewing or glueing difficult. It is, for example, necessary and known, for an exact folding operation, to cut off a strip from the upper bag edge, in order to obtain an accurate horizontal and vertical position of the latter. However, such a solution necessitates an additional mechanical outlay and the disposal of the cut-off material. To mitigate these disadvantages, it is proposed, for example in EP-A-293,615, for the closing of side-folding bags made of paper, to grasp the filled bag directly in the filling station in a clamping manner and to move it into the subsequent folding station by means of a slide. A disadvantage of this version, which is simple per se, is the fact that, although the open bag end can be grasped relatively accurately, the preshaped structure can nevertheless often be received only with great inaccuracy.

According to EP-A-123,784, it is proposed, before folding, to detach a paper layer by a few centimeters and subsequently to glue the tab thus formed as a protective tab directly, via the folding point, to a point on the bag material which is located outside the folding point. This can afford an additional safeguard of the bag closure against peeling open, even when the adhesive bond is not made in the best possible way. Here too, a disadvantage is a complication of the folding operation which, particularly in the case of a high plant capacity, can impair reliability. Moreover, use is possible only in the case of multi-layer paper.

A similar solution is described in DE-A-2,520,744, the operator's choice of bag material being restricted by a special bag make-up.

SUMMARY OF THE INVENTION

One object on which the invention is based is, whilst avoiding the disadvantages of the state of the art which have been indicated, to develop a method for the automatic closing of transport bags, which makes it possible to obtain a simple and accurate closing of the transport bags at performances of approximately 1,200 bags per hour and pack masses of at least 5 kg to approximately 50 kg per bag. This object is achieved according to the characterizing features of claim 1.

The object on which the invention is based is, furthermore, to provide an apparatus for carrying out the method, in which a high flexibility as regards the size and shape of the bags used, preferably made of paper, is to be achieved.

The solution according to the invention is characterized in that the free-standing upper edge of a field transport bag is spread from inside in a way known per se and at the same time a side fold is worked in on both sides from outside, and subsequently the bag is aligned vertically by finely adjusting its height.

This is followed by a clamping known per se, but the aligned bag is fixed in its height position in a way not previously known, in order to allow the spreading knives to emerge, and is fed for pre-grooving and for first folding. This is followed by a further grooving and the application of an adhesive film, and the folding and adhesive bonding of the two folds.

The immediate intensive pressing of the adhesive joint in press rollers ensures a leakproof connection which already acquires most of its final strength in a very short time after leaving the bonding rollers.

During the entire process, the bag is located on a horizontal base, a transport element, preferably a conveyor chain, and its position is monitored by sensor means.

The transport element is also adjustable in height and has a reliable longitudinal stabilization. It is also thereby possible to use trapezoidal height-adjusting elements of simple construction to perform coarse height adjustments.

Preferably, the bag, after being filled and set down onto the transport element, is moved continuously and constantly, also in order to avoid a kinking of the bag.

Comprehensive tests found that the linking of individual functions known per se with new functions, by the use of sensor/robot means and controllers, can provide a completely new generation of plants with sometimes surprising results. The apparatus for carrying out the method according to the invention is characterized by a comparatively low mechanical outlay and space requirement. Hitherto conventional accessory apparatuses, for example for trimming the bag edges and for disposing of the waste, become unnecessary.

The use of robot means and sensors, in addition to accurate movements, also allows the recording of regulating variables in controlled movement sequences. A drift of regulating variables can be used to draw the attention of the average person skilled in the art to known varied external and internal operating conditions.

Precisely during bagging with unstable paper bags and varying properties of the material to be bagged in the course of minutes or hours as a result of external circumstances and conditions, an active follow-up of predetermined parameters is unavoidable in order to maintain fault-free, automatic and unmanned production.

It was recognized, according to the invention, that even the operation of spreading the bag must take place accurately and with a specific force effect. A deep penetration of the spreading elements (knives) into the bag near to the material surface makes it possible, moreover, to express air inclusions effectively. As a result of the preferred use of two respective internal knives and of a gusset knife for making a gusset (or the use of the gusset knives for the internal spreading of a bag without a gusset), a bag which is tensioned uniformly all-round is obtained by the transverse spreading of the internal knives before the pressing in of the side folds. This results, by virtue of identical side lengths of the bag front side and rear side, not only in a better appearance, but, above all, in a higher leakproofing of the closure. The spreading elements are moved in coordination with the transport element.

The frictional connection between the spreading knives and bag wall is also utilized to bring the upper edge of the bag into the correct position, in other words, to vertically align the upper edge as a result of the movement of the spreading elements downwards or upwards by means of the same drives which execute the plunging movement of the spreading elements.

It is thus possible for the first time to achieve an accurate preparation of the open upper part of the bag for the actual closing, without a bag-edge cut or such like manipulations.

The draw-in of the bag into the closing apparatus preferably takes place in such a way that only a horizontal distance from bag to bag on the conveyor band is necessary. This becomes possible, for example, by means of a double-jaw draw-in system. Moreover, a parallel setting of the front jaw parts makes it possible to move the clamping carriage, movable thereon, at a constant distance from the bag. The bag is thereby held fixed in its position even during the withdrawal of the spreading knives, while the jaws, as holders of the clamping belt, are still non-closed. The clamping force in the jaw, as in the immovable part, is freely selectable and reject bags can be removed by releasing the clamping force, if necessary also by selectively releasing the clamping force in the movable or stationary part, in which a faulty bag is located at that time. The transport element is lowered parallel thereto.

The folding of the bag advantageously takes place in a plurality of steps. In the first place, a pre-grooving and turning round of the fold takes place, irrespective of the paper thickness. The grooving rollers are cylindrical, so that the upper part of the roller of the second folder can serve at the same time as a press roller for the first fold.

The folding apparatuses are preferably of adjustable height, in order to allow any folding widths. The folding channel is preferably designed so that tensions in the folding region of the bag can be reduced. Sensors for recognizing faulty bags are arranged preferably in the region of the pre-grooving (first grooving).

Immediately after the second grooving, the application of adhesive takes place, the application nozzle preferably being movable in a curve-like manner, in order to achieve an optimum position of the adhesive bead and as constant a distance as possible between the adhesive edge and the first fold over the entire bag width. This is again irrespective of the paper thickness and of arcuate or slightly kinked folds.

Pressing of the adhesive joint preferably takes place by means of press rollers in an arrangement in pairs, in order to achieve high specific pressing, thus resulting in the very short pressing times and, by virtue of good distribution and intensive wetting of the paper, in a low adhesive requirement.

The apparatus according to the invention allows continuous and unmanned operation at a high performance, since, first, all the movements take place in a recipe-controlled manner by means of the robot means, sensors and controllers, second the recipe-related parameters are followed up automatically in the case of changing conditions, and third, because the freely programmable axes can at any time automatically process a different bag format by program control (correction after recipe control and readjustment after assessment).

The binding member between the individual stations is the transport element.

DESCRIPTION OF THE PREFERRED EMBODIMENTS

A bag 1 (transport bag made of paper) opened in a known way and filled, for example, with meal in a filling station is set down onto a transport element 3 and is accelerated to the necessary level (see FIG. 5) and moved further continuously and constantly.

Figure 1:
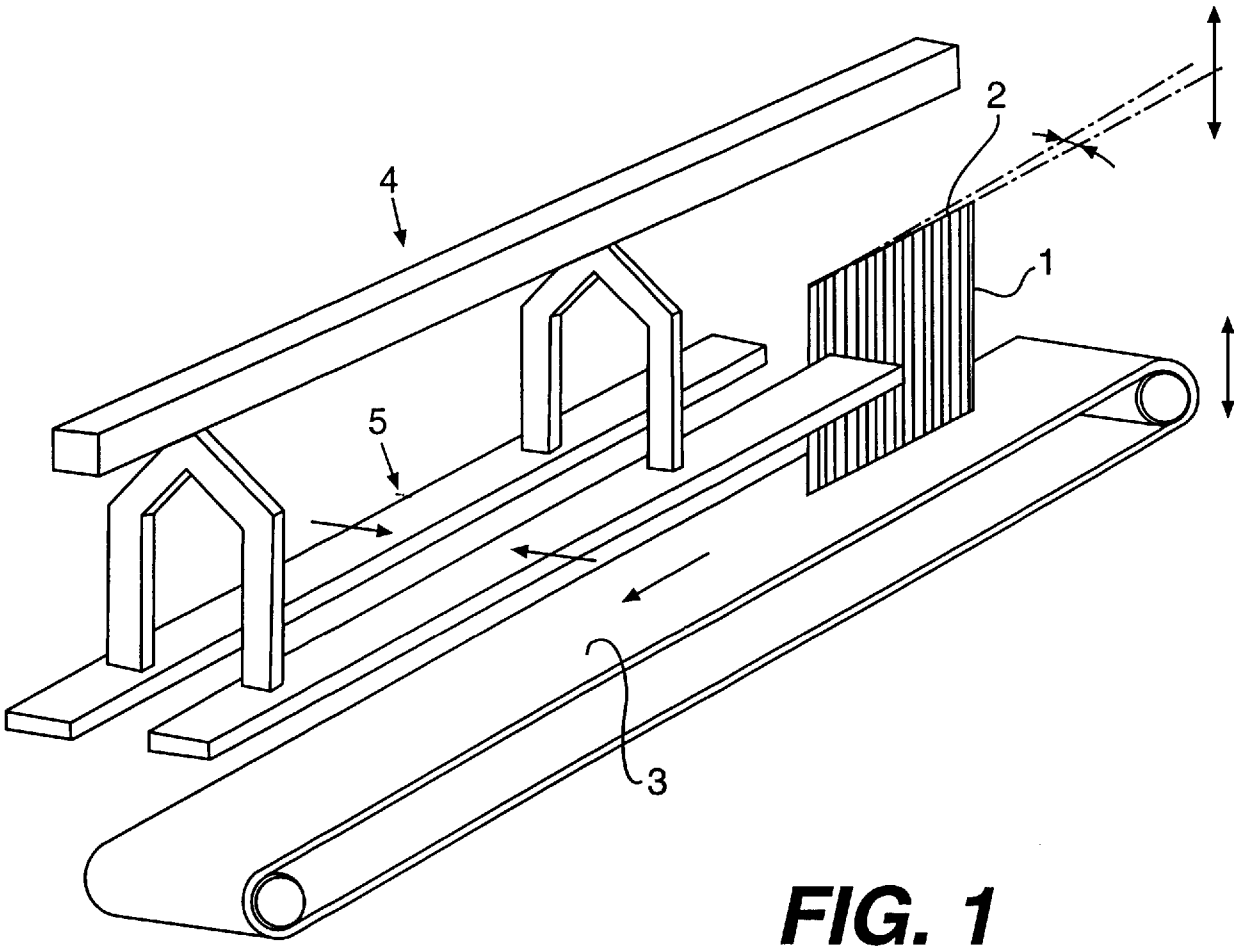
FIG. 1 shows the alignment according to the invention after the spreading of the bag edge.

FIG. 1 shows diagrammatically the combination according to the invention of the preceding spreading and alignment, shown here, of the bag 1, especially of the bag edge 2. The bag edge 2 can be aligned both horizontally and vertically. It is essential that, after the alignment according to the invention, the bag edge 2 is guided in an unchanged height position through the subsequent processing stage 4. Provided for this purpose is a clamping conveyor band 5 which can be driven synchronously with the transport element 3.

The height of the bag edge 2 can vary, for example, as a result of external conditions, such as a changed product volume, with the same weight, or different bag dimensions.

Figure 2:
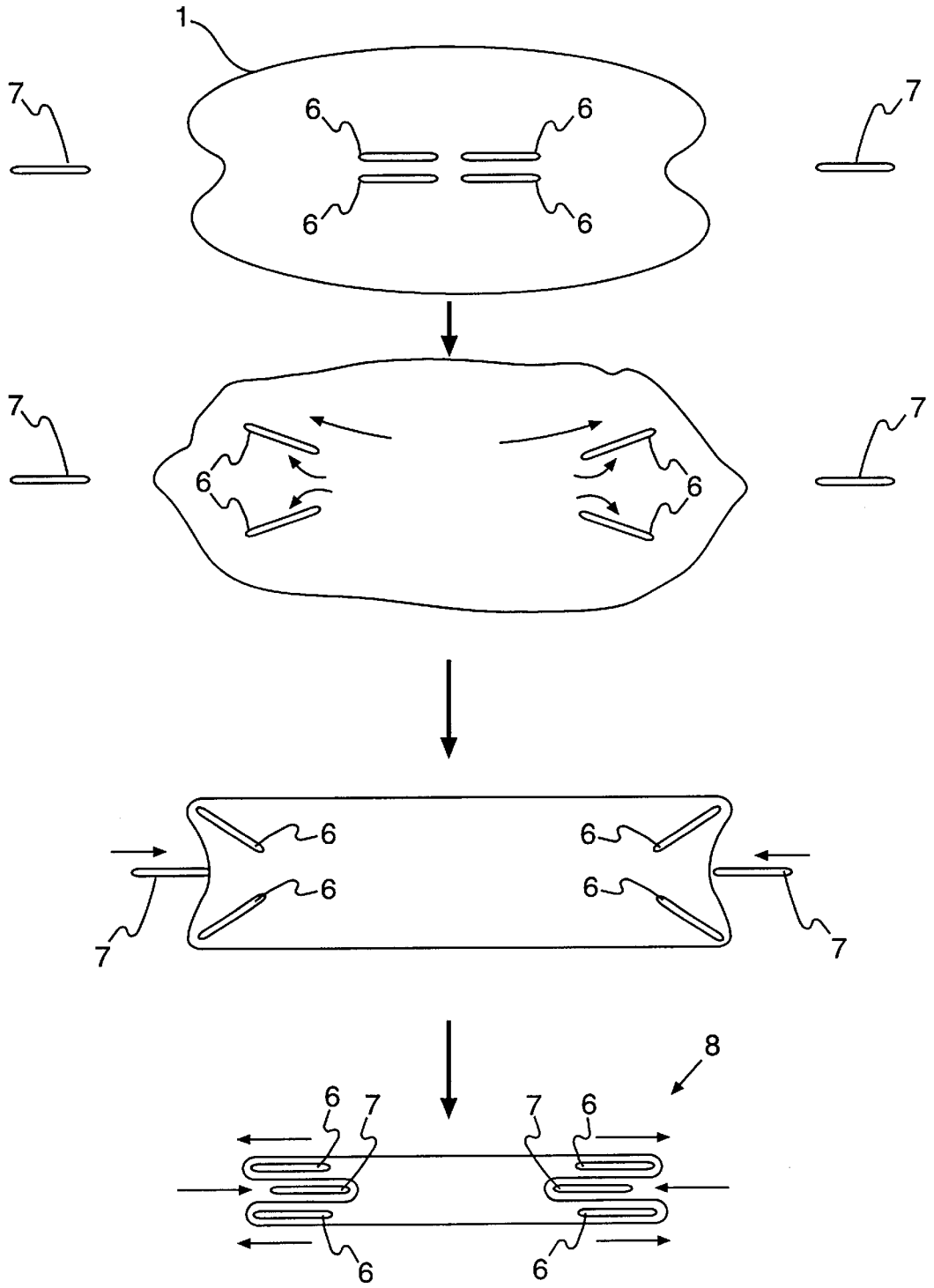
FIG. 2 shows the spreading of the bag in steps (as a precondition for straightening)

FIG. 2 shows the main steps in the spreading of the bag. First of all, the spreading elements are lowered and the internal knives 6 penetrate preferably deep into the bag 1 to just above the level of the meal, whilst a gusset knife 7 is ready on the outside near each of the narrow sides of the bag 1. The bag material is tensioned to form a rectangle as a result of the opening of the internal knives 6 in the transverse direction, the gusset knives 7 at the same time moving inwards and forming the gusset 8. Via the gusset knives 7 in particular, an adjustable tension force is generated on the bag material and makes it possible to align the bag orifice by means of all the knives both horizontally and vertically.

The transverse spreading as a result of the outward rotation of the internal knives 6 results, before the pressing in of the side folds, in a bag 1 tensioned uniformly all-round. The rotation for the transverse spreading takes place, for example, by means of pneumatic cylinders, the piston and piston rod having a centre of rotation at the front on the piston rod and on the piston itself respectively, so that there is no need for a piston-rod guide and a separate rotary joint and therefore constructional length is also saved.

The use of two respective internal knives 6 and a respective gusset knife 7 makes it possible to make a gusset 8 or to use the gusset knives 7 for the internal spreading of bags 1 without a gusset 8, the gusset knives 7 assuming the starting position of the internal knives 6 and the internal knives 6 assuming a parking position in the position of the gusset knives 7. In order to carry out such an exchange of functions, the altogether six knives 6, 7 move on only two rails not shown explicitly, with a holder of the internal knives 6 engaging over a running carriage of the gusset knives 7 in a U-shaped manner. Preferably, two motors drive the internal knives 6 and the gusset knives 7 independently of one another on the respective common rails via a pulling means in a way known per se by the utilization of a forward and a return belt strand. This allows a synchronous, opposed direction of movement of the two respective associated carriages for the internal knives 6 and gusset knives 7. The drive chains for the driving pinions of the gusset-knife and internal-knife belts preferably also serve as bearing points for the deflecting pinions of the contrary axis. The driving pinion for the internal knives 6 is preferably coupled fixedly to the shaft, whilst the deflecting pinion for the gusset knife 7 is loose.

The correct plunge starting point of the spreading elements is determined by recording the bag width via light barriers known per se.

A weight compensation of the knife holders by means of compressed-air cylinders loaded on one side allows lower drive forces and therefore lighter motors up to and including the drive of the entire shaft.

Robot means known per se, including sensors and controls, ensure an accurate real-time movement cycle.

For the subsequent vertical straightening or adjustment (FIG. 5), straightening optics adjustable to the bag formats to be processed are provided. The straightening optics can be placed freely in the system of coordinates in a simple way. The regulation of the height of the upper face of the bag edge 2 (and therefore also the height position of the band of the transport element) in relation to the spreading apparatus takes place by means of a comparison of the detected actual straightening travel with a predetermined desired straightening travel. A variation in the height of the upper face of the bag edge 2, for example as a result of different filling material, is thus compensated for by an adjustment of the height of the band of the transport element. There is therefore no need for permanent observation or manual action. This height adjustment is in addition to the vertical alignment performed using the spreading knives, as described above.

The draw-in of the bag 1 into the closing unit takes place by means of a double-jaw draw-in system (FIG. 1, clamping apparatus 4), with the result that a bag spacing on the transport element 3 of the order of magnitude of the bag width is possible. The jaw construction with a double joint allows the parallel setting of the front pair of jaws, thus allowing the mounting of the clamping carriage (clamping conveyor band 5) on clamping-carriage rails aligned parallel to the run-through direction of the bag 1 and consequently a movement of the clamping carriage at a constant distance from the bag 1.

The "ready-spread" bag 1 is held by the clamping carriage during the movement of the internal knives 6 out of the bag 1 (FIG. 5), in order to avoid variations in position of the bag 1 at a moment when the clamping band is not yet closed, but the internal knives 6 are already moving out of the bag 1.

The return transport of the clamping carriage takes place, without its own drive, merely as a result of frictional connection on the returning strand of the clamping band.

The clamping of the bag 1 for synchronous transport by the closing apparatus takes place by means of vertically guided profiled toothed belts in a manner pressed down pneumatically, thus allowing a freely selectable setting of the clamping force with a pressure regulation involving a low outlay. The pressure pistons are located in a cylinder open at the front, and a lip acts as a stripper on the front side and as a seal on the cylinder side.

Reject bags and the like can be removed automatically by bleeding the clamping-band air in sectors in the region of the respective bag 1 and by lowering the transport element 3.

Figure 3:
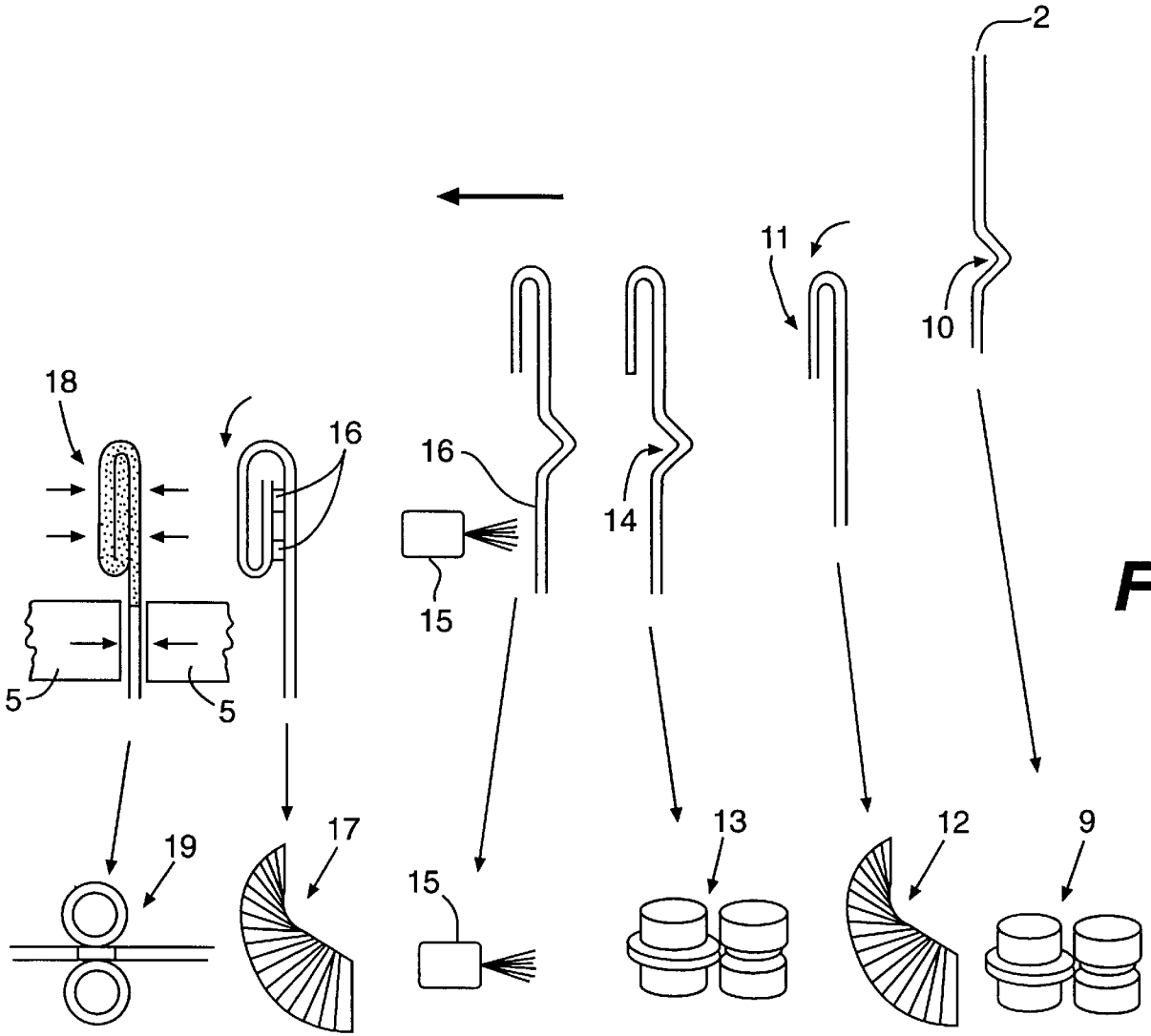
FIG. 3 shows essential steps in the folding and glueing of the bag.
Figure 4:
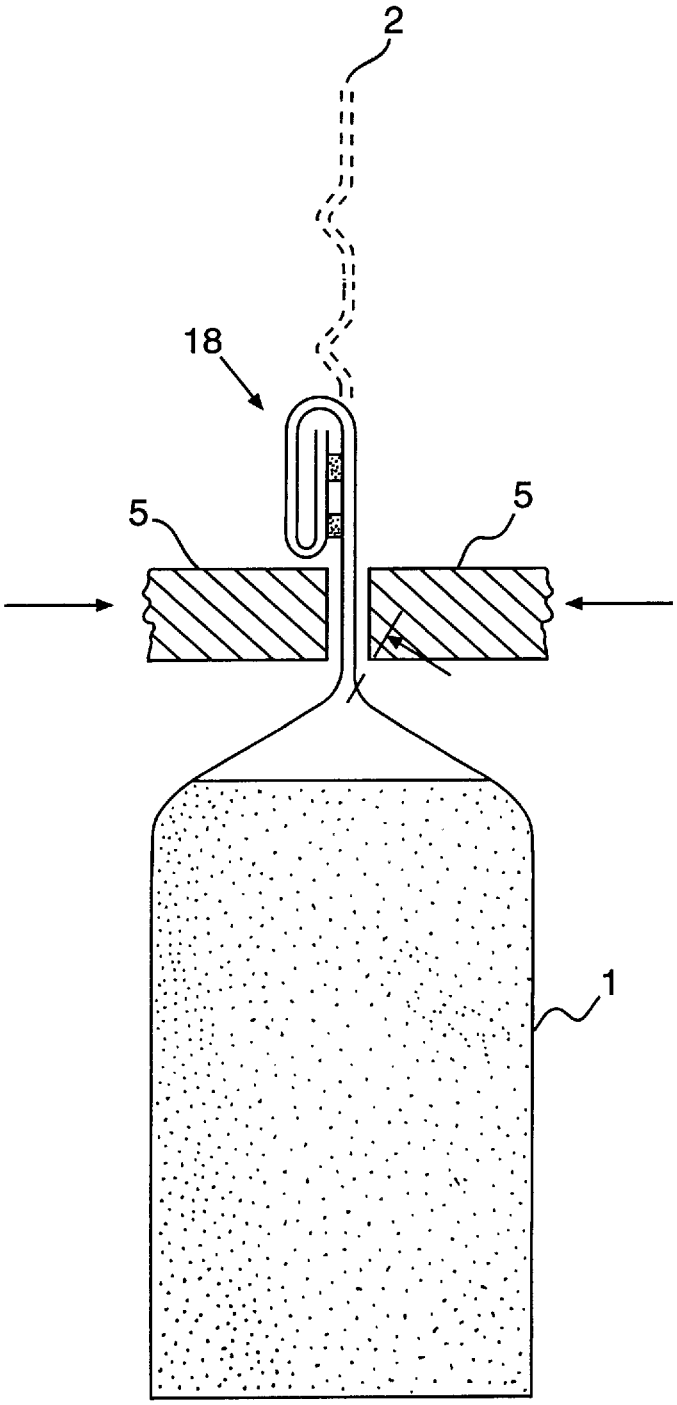
FIG. 4 shows the closed and glued bag still held by a clamping conveyor band.

FIG. 3 shows the main steps in the folding and glueing of the open bag edge 2 of the clamped bag 1. A first pair of grooving rollers 9 produces a first grooving 10 (pre-grooving). The first fold is subsequently made via a first folding apparatus 12. A second pair of grooving rollers 13 thereafter produces a second grooving 14. An adhesive film 16 is then applied via a glue nozzle 15 in a way still to be described. This is followed directly by the second folding by means of a second folding apparatus 17, whereupon the double fold 18 formed is brought to a firm and flat bond in a pair of press rollers 19.

The adhesive joint is subsequently cooled passively by the ambient air in a way known per se, and the closed bag 1 is then fed for further treatment (palletization or the like).

As a result of the pre-grooving (grooving 10), a loose turning round of the fold 11 in a spiral channel of the folding apparatus 12 is possible with low friction and irrespective of the paper thickness of the bag 1. As a result of the cylindrical design of the grooving rollers 9, 13, the grooving roller 13 can serve at the same time as a press roller for the first fold 11. Only one roller at a time is driven, and the second of a pair is respectively driven on the circumference by friction, so that mechanical overdrive can be avoided.

The folding height and folding position can be set automatically, so that the length of the closed bag 1 is freely selectable for the purpose of optimum adaptation to the pallet size.

The design of the folding channel as a shaft with parallel side walls, between which the folded-round bag part runs after passing through the spiral folder, makes it possible to reduce tensions in the folding region which are caused by distances of unequal length which the fold front edge has to cover in relation to the part in the folding region. This results not only in a straight fold 11, but also in the possibility of an extremely short spiral folder, if no more stringent requirements are placed on the straightness of the fold 11.

By means of optical limit switches (positionable according to the fold width) after the first grooving rollers 9, wrongly aligned bags 1 can be recognized and sorted out. Also, here too, bags 1 with a wrong weight and the like can be ejected.

In general, faulty bags are ejected at the latest at the end of the closing apparatus, in order to prevent the possibility that such faulty bags will pass on to a palletizer or the like.

The glue nozzle 15 is arranged in a fixed or curvedly movable manner on a positioning axis perpendicular to the folding axis. By means of a curve control, despite a typically slightly arcuate/kinked fold 11, an adhesive film 16 running parallel to this fold 11 can be applied, especially also in the initial region of the latter. Likewise, differing thicknesses of the adhesive film 16 or of an adhesive bead can be corrected so that, after pressing, the adhesive reaches exactly as far as the lower fold edge.

With the setting of the folding position being the same, different paper thicknesses result in folds of unequal width as a result of a neutral fibre of unequal length in the bending radius. As a result, the absolute position of the ideal line of application of the adhesive is displaced. This typical behaviour can be corrected by means of the curve control and a recipe management for each bag format.

During the starting and stopping of the glue nozzle 15, glue is absent on the first and last millimeters of the applied adhesive bead or adhesive film 16. After pressing, this has an effect on the width of the adhesive film 16. In order to correct the fish shape which occurs and to bring the adhesive edge into coincidence with the fold edge, the curve control is used.

The use of a pair of press rollers 19 instead of a conventional longer press zone allows a very high pressing of the adhesive along a line with a small amount of force required. The high specific pressing (calender-like) makes it possible to roll out the adhesive into a thin film, with the paper being wetted over a large area into the very pores of the material, and thus makes it possible to obtain a large adhesive area. This is important in order, even in the case of peeling-off movements, to prevent the closure from being torn open.

Moreover, a thin adhesive film 16 is flexible under bending stress and is less inclined to tear open in comparison with thick adhesive joints conventionally pressed between bands, and less adhesive is consumed. Also, the cooling time is shorter and the bag 1 can be loaded as early as immediately after leaving the press rollers 19. The pressing time amounts to approximately ½ a second and approximately 80% of the final strength is reached immediately. It was impossible to detect peeling-open problems in comprehensive tests. The constructional length of the closing apparatus is also reduced.

In the same way as the grooving rollers 9, 13, only one press roller 19 is driven and the second is actuated via the friction on the circumference. The force flux on the circumference is always maintained, with or without a clamped bag 1.

Figure 5:
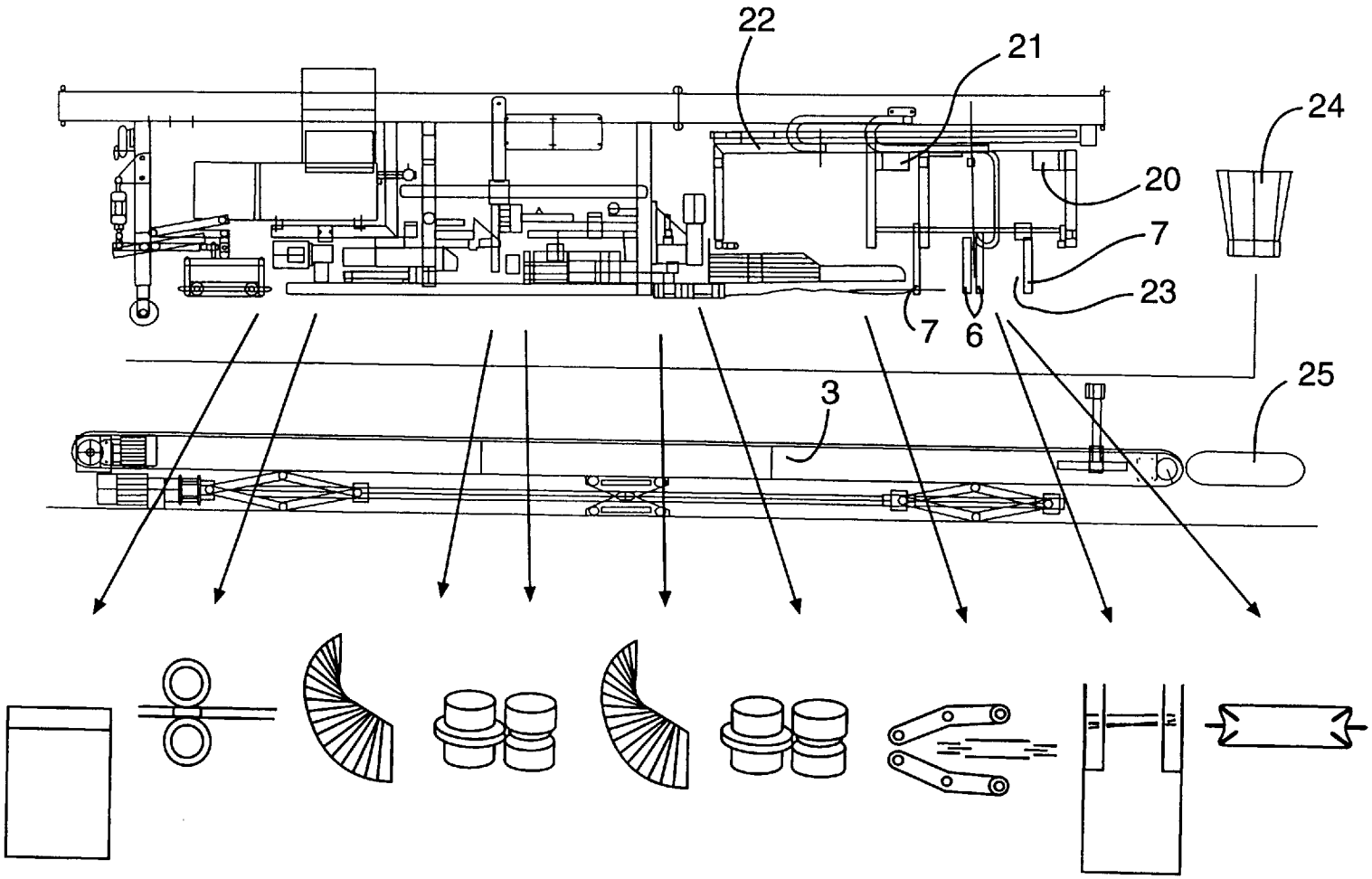
FIG. 5 shows the apparatus for the automatic closing of transport bags with a representation of the individual actions.

FIG. 5 illustrates an entire closing apparatus. The spreading apparatus has independently controllable drives 20, 21 for the internal knives 6 and gusset knives 7, which allow a one-sided or two-sided height adjustment and subsequent alignment. Via a fluid drive or position drive (internal knives 6), drives not shown, the knives can be moved horizontally and a tension force correspondingly exerted. The spreading apparatus is movable parallel to the transport element 3 on a horizontal guide rail 22, in order to synchronize the spreader with the bag 1 and prevent the possibility of disturbing forces during the spreading operation. The aligning function is monitored via sensors 23, for example light scanners, and can be controlled or regulated in a robot-like manner by means of a process computer.

The filled bag 1 is brought onto the transport element 3 from a bagging station 24, a lateral guide 25 keeping the bag 1 vertical. For reasons of high operating reliability, the bags 1 are to be spaced at a uniform and short distance from one another.

Figure 6A:
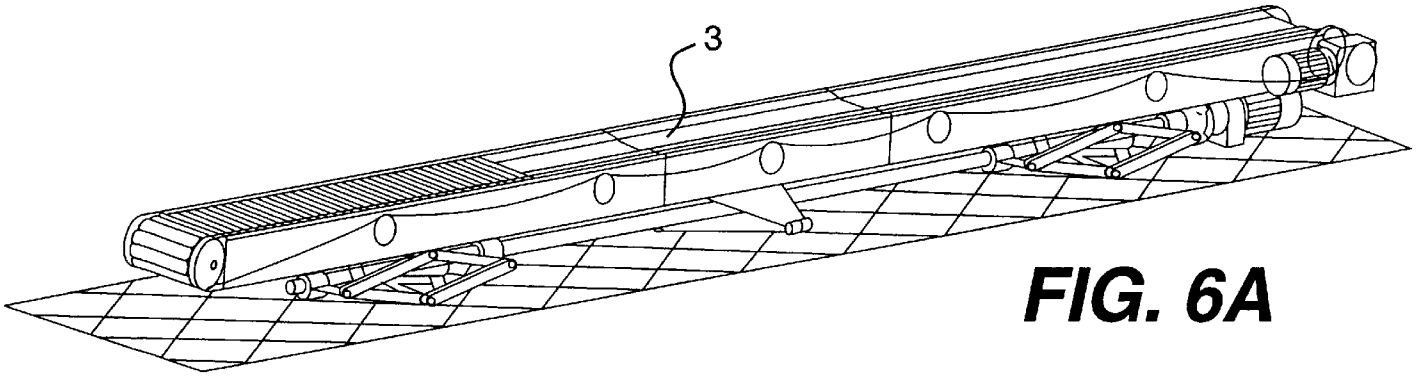
FIG. 6 shows the transport element of adjustable height in its end positions.
Figure 6B:
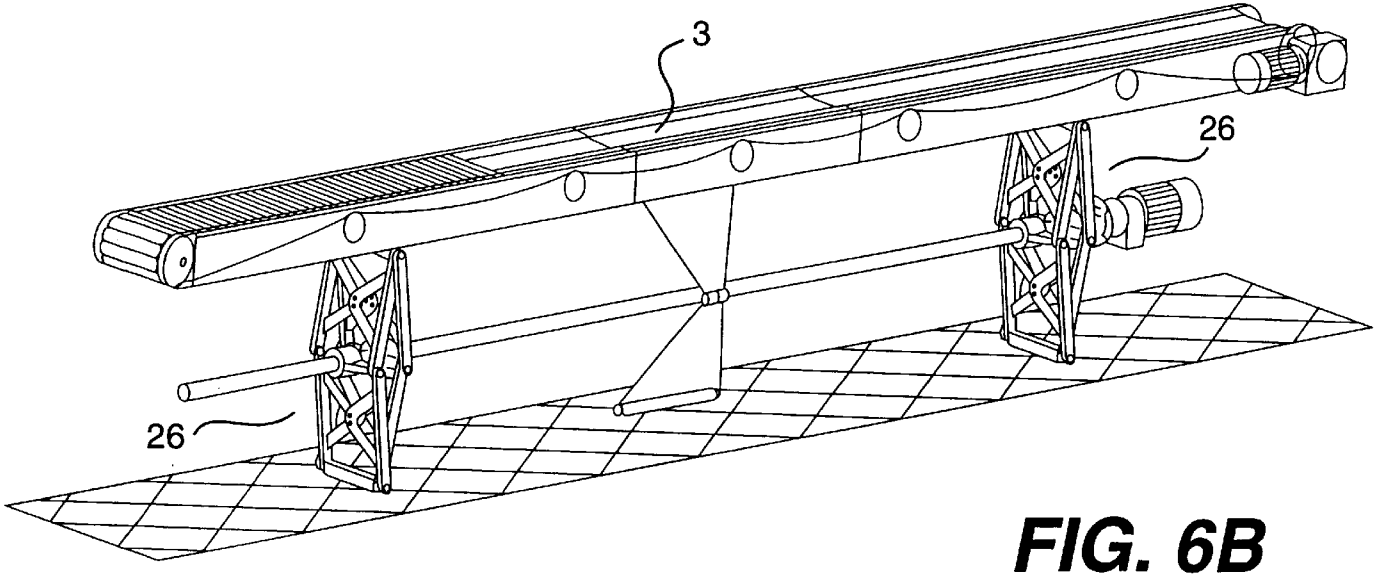

The transport element 3 (FIG. 6) can be adjusted in height in a coordinated manner by means of lifting trapeziums 26. The utilization of the integrated machine-control sensors for the simultaneous recognition of a faulty behaviour of the bags 1 via an object-related memory makes it possible to eject these bags 1 at the location designed for this purpose.

Moreover, the utilization of computer controls allows the mangement of bag-specific recipes, and an automatic setting to different bag formats is afforded via freely programmable axes. Incorrect settings in the case of a format change are virtually prevented. Machine-specific and method specific particularities can be corrected, and via controllers an automatic setting to changed internal and external conditions is afforded, even in the case of work carried out in batches as a result of the storage of controller values.

List of Abbreviations

1 bag
2 bag edge
3 transport element
4 clamping apparatus
5 clamping conveyor band
6 internal knife
7 gusset knife
8 gusset
9 grooving roller
10 grooving
11 fold
12 folding apparatus
13 grooving roller
14 grooving
15 glue nozzle
16 adhesive film
17 folding apparatus
18 double fold
19 press roller
20 drive
21 drive
22 guide rail
23 sensor
24 bagging station
25 lateral guide
26 lifting trapezium

What is claimed is:

1. A method for automatically closing and sealing bags filled with a predetermined quantity of bulk material, the bags having a base and a top with sides and an upper edge, the method comprising the steps of:

vertically positioning a spreading device within the bag;

spreading open the bag top using the spreading device;

sensing the height of the bag top and comparing the sensed height to a reference height;

adjusting the height of the spread bag top upper edge accordingly by adjusting the vertical position of the spreading device;

transporting the height adjusted bag to clamping and sealing apparatus while maintaining the bag top upper edge at the adjusted height using the spreading device; and clamping and sealing the bag.

2. The method as in claim 1, further including the step of aligning the sides of the bag top using the spreading device, said aligning step being carried out concurrently with said spreading step.

3. The method as in claim 1, further including the step of forming vertical folds in the bag top sides using the spreading device.

4. The method as in claim 1, wherein the transporting step is carried out using a horizontal transport device supporting the base of the bags, wherein the step of transporting the bags using the transport device includes transporting the bags concurrently with the spreading and adjusting steps.

5. The method as in claim 4, including the preliminary step of setting the height of the transport device in accordance with the type and/or loading of the bags to be closed and sealed.

6. The method as in claim 1, wherein the adjusting step includes the substeps of sensing the height of the upper edge of the spread bag, comparing the sensed height with a desired height, and vertically raising or lowering the bag top accordingly using the spreading device.

7. The method as in claim 1, wherein said spreading device includes a plurality of spreading knives vertically and horizontally movable, the spreading step including the substeps of inserting the knives vertically into the bag top and separating the knives horizontally against the inside surfaces of the bag sides.

8. The method as in claim 7, wherein the separating substep includes the further substep of tensioning the bag sides to provide frictional engagement between the knives and the bag sides, and wherein said adjusting step includes the substep of adjusting vertically at least some of the frictionally engaged spreading knives.

9. The method as in claim 8, wherein vertical positions of all the spreading knives are adjusted the same amount.

10. The method as in claim 1, further including the steps of contracting the spread open height-adjusted bag top using the spreading device, and the clamping and sealing step includes clamping the contracted bag top while maintaining the bag upper edge at the adjusted height.

11. The method as in claim 10, wherein the spreading device includes a first plurality of spreading knives vertically and horizontally movable and a second plurality of vertically and horizontally movable gusset knives, and wherein said contracting step includes cooperatively engaging the front and rear bag sides, with respect of the direction of transporting, using the spreading and gusset knives to form vertical gusset folds, and said clamping step includes initially clamping the contracted bag at a location intermediate the respective front and rear sides to allow withdrawal of the spreading and gusset knives while maintaining the bag upper edge at the adjusted height.

12. The method as in claim 10, wherein said clamping and sealing step further includes the substeps of:

(i) making a first horizontal groove in the contracted and clamped bag at a predetermined height below the adjusted upper edge of the bag;

(ii) first folding the grooved bag along the groove to provide a folded bag portion;

(iii) making a second horizontal groove in the bag at a predetermined height below the folded bag portion;

(iv) applying adhesive to the bag below the second groove;

(v) second folding the bag along the second groove, the folded bag position being disposed over the adhesive to provide a final folded bag portion; and (vi) applying pressure to the final folded bag portion to seal the bag.

13. The method as in claim 12, wherein the first and second folding substeps are carried out using spiral folders and folding channels.

14. The method as in claim 12, wherein said adhesive applying substep is carried out using a curve-controlled nozzle.

15. The method as in claim 12, wherein said second grooving substep and said adhesive applying substep are carried out simultaneously.

16. The method as in claim 12, wherein said pressure applying substep is carried out using press rollers.

17. Apparatus for automatically closing and sealing bags filled with a predetermined quantity of bulk material, the bags each having a base and a top with sides and an upper edge, the apparatus comprising:

a transport device for supporting a filled bag at its base in a generally upright orientation and transporting the bag in a direction;

a sensor positioned to sense the height of the upper edge of the bag and a control means operatively connected to said sensor for comparing the sensed height to a reference height;

a controllable spreading device for vertically moving into the bag, engaging the supported bag sides, spreading open the bag top, vertically moving to adjust the height of the bag upper edge accordingly by adjusting the vertical position of the spreading device, and contracting the height-adjusted bag top;

a clamping device cooperating with said spreading device for clamping the contracted bag top while maintaining the bag top at the adjusted height;

a sealing device positioned to receive and seal the clamped contracted bag;

said control means operatively connected to said spreading device and said clamping device.

18. The apparatus as in claim 17, wherein the bag is continuously transported by said transport device, and wherein said spreading device includes a carriage reciprocally movable in said transport direction along with the bag.

19. The apparatus as in claim 17, wherein said spreading device includes a plurality of vertically oriented spreading knives, first drive means for selectively vertically moving the spreading knives into or out of the bag top, and second drive means for selectively horizontally moving the spreading knives against or away from the bag sides.

20. The apparatus as in claim 19, wherein said first drive means includes separate insertion and withdrawal motors.

21. The apparatus as in claim 17, including height sensors operatively connected to said control means and positioned for sensing the height of the supported bag upper edge.

22. The apparatus as in claim 17, including side position sensors operatively connected to said control means and positioned for sensing the horizontal position of the bag sides.

23. The apparatus as in claim 17, wherein said clamping device includes opposed clamping arms positioned to initially contact the bag sides intermediate the front and rear bag sides relative to the transport direction.

24. The apparatus as in claim 17, having four spreading knives arranged in opposed pairs, each pair horizontally movable against the inner surfaces of the front and rear bag sides respectively, wherein the apparatus further includes two gusset knives each horizontally movable against the outer surface of a respective one of the front and rear bag sides in cooperation with a respective spreading knife pair to form front and rear vertical gusset folds for contracting the bag top.

25. The apparatus as in claim 17, wherein said transporting device includes a vertically adjustable band for supporting the bag base.

26. The apparatus as in claim 17, further comprising:

(i) a first grooving device positioned for making a horizontal groove in the contracted and clamped bag at a predetermined height below the adjusted upper edge;

(ii) a first folding device positioned for folding the grooved bag along the groove to provide a folded bag portion;

(iii) a second groove forming device positioned for making a second horizontal groove in the bag at a predetermined below the folded bag portion;

(iv) an adhesive applying device positioned for applying adhesive to the bag below the second groove;

(v) a second folding device positioned for making a fold along the second groove and disposing the folded bag portion over the adhesive, thereby providing a final folded bag portion; and (vi) a pressure-applying device positioned for applying pressure to the final folded bag portion to seal the bag.

27. The apparatus as in claim 26, wherein said first and second folding devices include respective spiral folders and folding channels.

28. The apparatus as in claim 26, wherein said adhesive applying device includes a curve-controlled nozzle.

29. The apparatus as in claim 26, wherein said pressure applying device includes press rollers.

30. The apparatus as in claim 26, wherein said control means is operatively connected to said first and second folding devices and includes means for preselecting the first and second folding heights, and wherein the apparatus further includes means operatively connected to said control means for identifying incorrectly folded bags.

* * * * *